United States Patent [19]

Katoh

[11] Patent Number: 4,579,440

[45] Date of Patent: Apr. 1, 1986

[54] COPYING MACHINE WITH A COMMON IMAGE EXPOSURE AND OPTICAL DISCHARGE DEVICE

[75] Inventor: Itsurou Katoh, Nara, Japan

[73] Assignee: Sharp Kabushiki Kaisha, Osaka, Japan

[21] Appl. No.: 551,726

[22] Filed: Nov. 15, 1983

[30] Foreign Application Priority Data

Nov. 18, 1982 [JP] Japan ..... 57-203133

[51] Int. Cl.[4] ..... G03G 15/00

[52] U.S. Cl. ..... 355/3 R; 355/3 CH; 355/3 TR; 355/14 E

[58] Field of Search ..... 355/14 E, 15, 67–71, 355/3 R, 3 CH, 3 TR, 14 CH, 14 TR

[56] References Cited

U.S. PATENT DOCUMENTS

| | | | |
|---|---|---|---|
| 4,087,170 | 5/1978 | Sawaoka et al. | 355/15 Y |
| 4,141,648 | 2/1979 | Gaitten | 355/14 CH |
| 4,205,912 | 6/1980 | Yamaguchi et al. | 355/15 |
| 4,372,669 | 2/1983 | Fantuzzo et al. | 355/14 E |

*Primary Examiner*—A. T. Grimley

*Assistant Examiner*—J. Pendegrass

*Attorney, Agent, or Firm*—Birch, Stewart, Kolasch & Birch

[57] ABSTRACT

Disclosed is a copying machine using the same unit for commonly executing exposure and cleaning, while providing a copy of the original by causing the photoconductor to rotate through two revolutions. The copying machine sequentially executes operations including uniformly charging a photoconductor during its first revolution, image exposure via an exposure unit, forming a electrostatic latent image on the photoconductor, making the electrostatic latent visible via a developer unit and subsequent transfer of the developed image onto a copy paper, and cleaning of the residual toner from the photoconductor using the same developer unit during the second revolution of the photoconductor.

The copying machine executes image exposure using an image exposure unit during the first revolution of the photoconductor and also executes an optical discharge by commonly using the image exposure unit at the same position during the second revolution of the photoconductor.

6 Claims, 3 Drawing Figures

COPYING MACHINE WITH A COMMON IMAGE EXPOSURE AND OPTICAL DISCHARGE DEVICE

BACKGROUND OF THE INVENTION

The present invention relates to a copying device of a photoelectric copying machine incorporating a means for making a photocopy by applying a single unit capable of commonly executing development and cleaning while causing a photoconductor to rotate two full turns.

Conventionally, existing photoelectric copying machines provide components for performing charging, development, transfer, discharging, and cleaning, in such positions surrounding a photoconductive drum in order to form a toner image corresponding to the original picture before the toner image is transferred onto a copying paper.

In such a copying machine, there is a mechanism called a "two-rotation" process, by which, development and cleaning are executed at the same location. This requires the photoconductor to rotate twice, i.e., the latent image on the photoconductor is developed during the first revolution, while the residual toner, after the transfer, is cleaned during the second revolution.

This system provides operators with much convenience not only for implementing both the development and cleaning via the same device, but also for eliminating unnecessary rotation of the photoconductor when the optical sensor scans the photoconductor in relation to the exposure, while such a copying machine is quite advantageous due to its compact size, light weight, and low cost.

Nevertheless, since the markets of the copying machines have recently grown not only in many industries and offices, but also in a variety of stores and even in households as well, there is still an increasing demand for copiers which have a smaller size, lighter in weight, and lower cost.

SUMMARY OF THE INVENTION

The present invention primarily aims at providing a copying machine incorporating a two-rotation mechanism, which not only executes development and cleaning as well, but also makes substitutes for other components that are otherwise present in front of the photoconductor, so that a still smaller size, lighter weight, and lower cost can be realized.

Another object of the present invention is to provide a copying machine incorporating a two-rotation mechanism, which not only executes development and cleaning, but also commonly executes exposure and photoelectric discharge operations.

To achieve these objectives, a preferred embodiment of the present invention provides a photoelectric copying machine comprising a means for causing a photoconductor to be evenly charged during a first revolution of said the photoconductor, followed by an image exposure via an image exposure unit to produce an electrostatic latent image to be presented to the developer unit, followed by transfer of said the developed image onto a copying paper, while the residual toner on the photoconductor is cleaned by the same developer unit during the second revolution of the photoconductor. In a preferred embodiment, the image is formed by the exposure unit while the photoconductor enters the first revolution, and then, the photoconductor will enter a second revolution to cause the exposure unit to discharge the electrostatic charge.

Another preferred embodiment of the present invention provides a means for selectively controlling luminance of the photoconductor by a switching means via the first and second revolutions of the photoconductor so that luminance of the surface of the photoconductor is varied during the exposure and discharge cycles.

BRIEF DESCRIPTION OF THE DRAWINGS

The present invention will become better understood from the detailed description given below and the accompanying drawings which are given by way of illustration only, and thus are not limitative of the present invention and wherein.

DETAILED DESCRIPTION OF THE INVENTION

Figure 1:
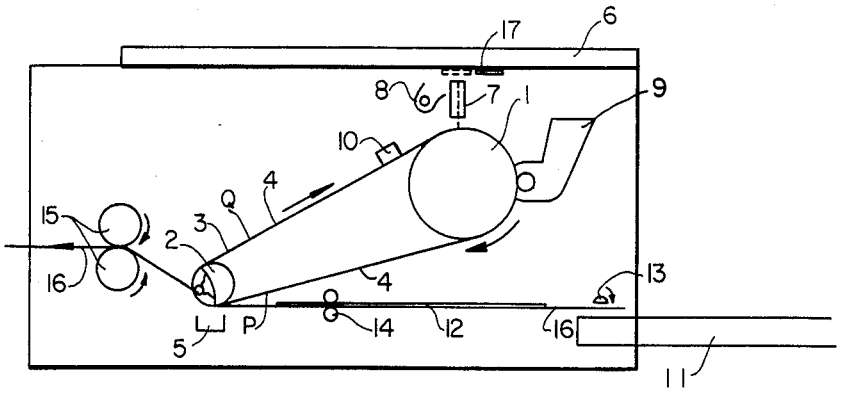
FIG. 1 is a sectional view showing the structure of a copying machine as a preferred embodiment of the present invention.

FIG. 1. is a sectional view of the internal structure of a copying machine according to the present invention. The copying machine comprises a first rotary drum 1, a second small-diameter drum 2 that makes up a pair of drums for supporting an endless belt 3, a photoconductor 4 provided above the belt 3 that is set between drums 1 and 2, charging unit 5 that uniformly charges the photoconductor 4 to a specific polarity, a mobile original document carrier 6, a lens 7 for directing reflective light of the original on the carrier 6, illuminated by the illuminator 8, onto the photoconductor 4, a developing unit 9, and a discharge unit 10. The photoconductor 4 has a position P at the leading tip portion and a position Q at the end portion, while it is translated in the direction of the arrow by rotation of drums 1 and 2. The photoconductor 4 stops at a position shown in FIG. 1.

As soon as the copying operation is initiated, drums 1 and 2 respectively start to move to cause the photoconductor 4 to also move. When the photoconductor 4 reaches the charging unit 5, the photoconductor 4 is charged by the unit 5 to a specific polarity. After the charge is completed, the photoconductor 4 will be transferred to the exposure unit comprising an illumination unit 8 and a lens 7. As soon as the tip portion P of photoconductor 4 reaches the projection position of the lens 7, the carrier 6 moves synchronous therewith so that the image exposure can be executed from the tip portion of the original, thus producing an electrostatic latent image corresponding to the original picture to be gradually formed from the tip portion of the photoconductor 4. Such a latent image is presented to the developing unit 9 to become a toner image. Thus, as soon as the photoconductor 4 has completed a full revolution, a toner image is formed on the photoconductor 4. When the photoconductor 4 starts to make the second revolution, synchronous with the arrival of the tip portion P at the position of the charger 5, a copy paper 12 being delivered to a predetermined position by a supply roller 13 from a cassette 11 will be transported by conveyer means, such as a conveyer roller 14, so that the paper top end will reach the position of the charger 5. The charger 5 also functions as an image transfer unit for electrostatically transferring the toner image from the photoconductor 4 onto the copy paper 12. In other words, the charging unit 5 not only charges the photoconductor 4, but also transfers the toner image during the second revolution.

As described above, while passing through the charging unit 5, that also functions as a transfer unit, the copying paper 12 will leave the photoconductor 4 by itself, which is then directed to the stationary roller along the transfer path 16 via guide means. The stationary rollers 15 cause the toner image on the paper 12 to be thermally fixed thereto , and the imaged paper is then sent forword via the paper transport path.

After passing through the transfer station, the photoconductor 4 reaches a discharge unit 10, which then discharges the residual charge. After this discharge is completed, any remaining charge is discharged via the illuminator 8 and lens 7. A white plate 17, which was not present in the exposure position when the rear end Q of the photoconductor 4 passed through the exposure position, is then set to the exposure position (shown by the dotted line) so that light reflected by the illuminator 8 will be uniformly irradiated via lens 7 onto the photoconductor 4, thus removing residual electrostatic charge.

Also, a white portion that executes a function corresponding to the white plate 17 may be provided in the lower tip portion of the carrier 6 if such a structure is provided, which allows the carrier 6 to return to the forward-movement start position upon completing a return movement as the tip portion P reaches the exposure position, so that the carrier 6 will pass through the exposure position following the rear end Q of the photoconductor 4.

After the residual electrostatic charge is discharged from the photoconductor 4, the developer unit 9 then removes the residual toner remaining on the photoconductor 4. After completeing these procedures, the process necessary for electrostatically copying the original onto a copy paper is completed. If a plurality of papers must be copied, the photoconductor 4 enters a third revolutions to repeat these operations thus described. As soon as a copy paper or the last copy of a plural of copy papers has been copied, the photoconductor 4 performs a total of 3 full revolutions so that any residual toner and electrostatic charge will be completely eliminated therefrom, and finally it stops at the position shown in FIG. 1.

As described above, in a preferred embodiment of the present invention charging and electrostatic transfer of the toner image are accomplished by using the same means. Although charging and electrostatic transfer can be achieved using the same polarity, they cannot always be achieved by applying the same voltage. To ensure correct operation, it is necessary to be able to supply voltages that are variable during the first and second revolutions of the photoconductor 4 at the discharge wire of the charging unit 5.

Figure 2:
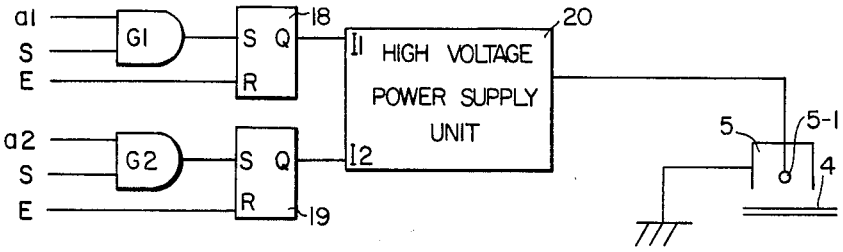
FIG. 2 is a simplified block diagram of the voltage switching controller of the charger.

An example is shown in FIG. 2. High voltage power supply unit 20 feeds a high voltage to wire 5-1 of the charging unit 5. The power supply unit 20 cannot feed such a high voltage to the wire 5-1 unless a signal is fed to input terminals I1 and I2. When the input terminal I1 receives a signal, it feeds a high voltage V1, suitable for charge, into wire 5-1. If a signal enters the input terminal I2, a high voltage suitable for transfer will be fed to wire 5-1. These input terminals I1 and I2 respectively receive signals from flip flops 18 and 19. Reset terminal 12 for flip flops 18 and 19 receives signal E indicating that the copying operation is completed. Set terminal S of flip flop 18 receives a signal from gate G1 that opens itself while both the copy start signal S and signal a1 denoting the first revolution of the first turn of the photoconductor 4 are present. Set terminal S of flip flop 19 receives a signal from gate G2 that opens itself upon entry of signals S and a2 denoting the second revolution of the photoconductor 4.

As a result, during the first turn of the sensitizer 4, voltage V1 being suitable for charge is fed to wire 5-1 of the charging unit 5, while voltage V2 suitable for transfer is fed to wire 5-1 during the second revolution of the photoconductor 4. If the identical voltage is fed to the charging and transfer operations, no means will be needed for controlling the high voltage switching operation shown in FIG. 2.

Figure 3:
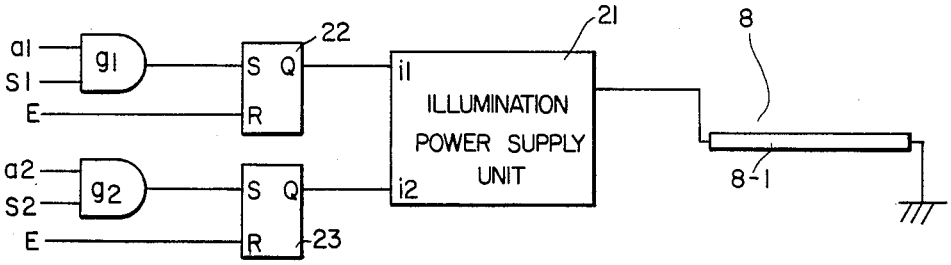
FIG. 3 is a simplified block diagram of a voltage switching controller of the illumination lamp.

A further preferred embodiment of the present invention executes the image exposure and the removal of residual electrostatic charge via the same means. As with the charging unit 5, the voltage supply means provides for application of different voltages. A typical example is shown in FIG. 3. Illumination power supply unit 21 feeds a voltage to a lamp 8-1 of an illuminator 8. Flip flops 22 and 23 respectively, feed set signals to inputs i1 and i2 of the power supply unit 21. Gates g1 and g2 are respectively connected to set terminal S of flip flops 22 and 23. Upon entry of the illumination start signal S1 while the photoconductor 4 still performs the first revolution, set signal from flip flop 21 is fed to input terminal i1 to cause the power supply unit 21 to drive lamp 8-1 with a voltage V1 that is suitable for the image exposure. When the illumination start signal S2 is fed during the second revolution of the photoconductor 4, the power supply unit 21 feeds a set signal from flip flop 22 to input terminal i2, driving lamp 8-1 with a voltage V2 suitable for discharging electrostatic charge. While discharging the charge photoelectricity, an operation for controlling the transfer of a white plate 17 to the dotted line is concurrently performed.

The preferred embodiment of the present invention shown in FIG. 1 typically denotes a structure in which a photoconductor 4 is provided on the belt 3. It is however unquestionably clear that the present invention is also embodied by a structure supporting the photoconductor 4 on drums.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A photoelectric copy machine for reproducing an original document on a copy paper comprising:

a photoconductor arranged to move in a revolving path;

a combined charging-transferring unit arranged to charge said photoconductor during movement of said photoconductor through a first revolution;

a combined exposing-discharging unit arranged to form an electrostatic latent image of the original document on said charged photoconductor during movement through said first revolution, said combined exposing-discharging unit including a means for varying voltage supplied to said exposure unit which varies the voltage suitable for image exposure and for discharging residual electrostatic charge via said exposure unit during said respective first and second revolutions of said photoconductor so that a luminance of said photoconductor varies between said exposure, first revolution, and optical discharge, second revolution, cycles;

a combined developing-cleaning unit arranged to develop said electrostatic latent image with toner particles on said photoconductor during the movement of said photoconductor through said first revolution;

means for positioning a copy sheet adjacent said toner image, said combined charging-transferring unit being arranged to transfer said toner image to said copy sheet during movement of said photoconductor through a second revolution, said combined exposing-discharging unit being arranged to illuminate said photoconductor to eliminate residual charge thereon after transfer of the toner image to said copy paper during movement of said photoconductor through said second revolution, said combined developing-cleaning unit being arranged to remove residual toner particles from said photoconductor after said combined exposing-discharging unit removes residual charge by said uniform illumination during movement of said photoconductor through said second revolution; said combined exposing-discharging unit being disposed exteriorly to said photoconductor for illuminating said photoconductor during said second revolution, said unit being positioned after said combined charging-transferring unit and before said developing-cleaning unit in the direction of movement of said photoconductor.

2. The copy machine of claim 1, wherein said means disposed external to said photoconductor for illuminating said photoconductor during said second revolution comprises a white plate for uniformly reflecting light via said combined exposing-discharging unit onto said photoconductor.

3. The copy machine of claim 2, further including means for varying voltage supplied at said combined charging-transferring unit.

4. A photoelectric copy machine for reproducing an original document on a copy paper comprising:

a photoconductor arranged to move in a revolving path;

a combined charging-transferring unit arranged to charge said photoconductor during movement of said photoconductor through a first revolution;

a combined exposing-discharging unit arranged to form an electrostatic latent image of the original document on said charged photoconductor during movement through said first revolution;

a combined developing-cleaning unit arranged to develop said electrostatic latent image with toner particles on said photoconductor during the movement of said photoconductor through said first revolution;

means for positioning a copy sheet adjacent said toner image, said combined charging-transferring unit being arranged to transfer said toner image to said copy sheet during movement of said photoconductor through a second revolution, said combined exposing-discharging unit being arranged to illuminate said photoconductor to eliminate residual charge thereon after transfer of the toner image to said copy paper during movement of said photoconductor through said second revolution, said combined developing-cleaning unit being arranged to remove residual toner particles from said photoconductor after said combined exposing-discharging unit removes residual charge by said uniform illumination during movement of said photoconductor through said second revolution; said combined exposing-discharging unit being disposed exteriorly to said photoconductor for illuminating said photoconductor during said second revolution, said unit further comprising a white plate for uniformly reflecting light via said combined exposing-discharging unit onto said photoconductor, said unit being positioned after said combined charging-transferring unit and before said developing-cleaning unit in the direction of movement of said photoconductor.

5. The copy machine of claim 4 wherein said combined exposing-discharging unit including a means for varying voltage supplied to said exposure unit which varies the voltage suitable for image exposure and for discharging residual electrostatic charge via said exposure unit during said respective first and second revolutions of said photoconductor so that a luminance of said photoconductor varies between said exposure, first revolution, and optical discharge, second revolution, cycles.

6. The copy machine of claim 5, further including means for varying voltage supplied at said combined charging-transferring unit.

* * * * *